US010717123B2

(12) United States Patent
Ito et al.

(10) Patent No.: US 10,717,123 B2
(45) Date of Patent: Jul. 21, 2020

(54) METHOD AND PRESS-FORMING APPARATUS FOR MANUFACTURING STRUCTURAL MEMBER FOR AUTOMOTIVE BODY

(71) Applicant: NIPPON STEEL & SUMITOMO METAL CORPORATION, Tokyo (JP)

(72) Inventors: Yasuhiro Ito, Tokyo (JP); Ryuichi Nishimura, Tokyo (JP); Kenichiro Otsuka, Tokyo (JP); Yoshiaki Nakazawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 585 days.

(21) Appl. No.: 14/913,851

(22) PCT Filed: Sep. 10, 2014

(86) PCT No.: PCT/JP2014/073970
§ 371 (c)(1),
(2) Date: Feb. 23, 2016

(87) PCT Pub. No.: WO2015/053035
PCT Pub. Date: Apr. 16, 2015

(65) Prior Publication Data

US 2016/0279692 A1 Sep. 29, 2016

(30) Foreign Application Priority Data

Oct. 9, 2013 (JP) ..... 2013-212069

(51) Int. Cl.
*B21D 22/26* (2006.01)
*B21D 5/16* (2006.01)
(Continued)

(52) U.S. Cl.
CPC ..... *B21D 22/26* (2013.01); *B21D 5/16* (2013.01); *B21D 53/88* (2013.01); *B21D 24/04* (2013.01)

(58) Field of Classification Search
CPC ..... B21D 5/0209; B21D 5/01; B21D 22/20; B21D 22/206; B21D 22/22; B21D 22/24;
(Continued)

(56) References Cited

U.S. PATENT DOCUMENTS 7,971,466 B2 * 7/2011 Yoshitome ..... B21D 22/02 72/355.2
2014/0144560 A1 5/2014 Yamano et al.
(Continued)

FOREIGN PATENT DOCUMENTS

CA 2 901 744 A1 9/2014
DE 10 2004 018 897 A1 11/2005
(Continued)

OTHER PUBLICATIONS

Canadian Office Action, dated Jan. 30, 2017, for corresponding Canadian Application No. 2,920,874.
(Continued)

*Primary Examiner* — Pradeep C Battula
(74) *Attorney, Agent, or Firm* — Birch, Stewart, Kolasch & Birch, LLP

(57) ABSTRACT

A method for manufacturing the structural member (1), the method including: a first step in which the pad (15, 15*A*, 15*B*, 15*C*, 21) presses the forming material (16) against the punch (13) to raise a portion corresponding to a flange to be formed in ends of at least the gutter bottom (2) and the ridge (3*a*, 3*b*) in a direction opposite to the pressing direction, the pad (15, 15*A*, 15*B*, 15*C*, 21) bends an end of a portion to be formed into the ridge (3*a*, 3*b*) in the pressing direction and restrains at least a part of the end, and the punch (13) and the
(Continued)

die (14) carry out press forming to form an intermediate product while a region other than an end in a portion to be formed into the gutter bottom (2) remains unrestrained.

16 Claims, 14 Drawing Sheets

(51) Int. Cl.
*B21D 53/88* (2006.01)
*B21D 24/04* (2006.01)

(58) Field of Classification Search
CPC ..... B21D 22/26; B21D 22/28; B21D 22/30; B21D 19/02; B21D 19/08; B21D 19/10
See application file for complete search history.

(56) References Cited

U.S. PATENT DOCUMENTS

| | | | |
|---|---|---|---|
| 2014/0191539 | A1 | 7/2014 | Sato |
| 2015/0061323 | A1 | 3/2015 | Otsuka et al. |
| 2015/0174634 | A1 | 6/2015 | Nishimura et al. |

FOREIGN PATENT DOCUMENTS

| | | | | |
|---|---|---|---|---|
| JP | 5-23761 | A | | 2/1993 |
| JP | 2007-111725 | A | | 5/2007 |
| JP | 2009-255116 | A | | 11/2009 |
| JP | 2009255116 | A | * | 11/2009 |
| JP | 2009-286351 | A | | 12/2009 |
| JP | 4438468 | B2 | | 3/2010 |
| JP | 2010082660 | A | * | 4/2010 |
| JP | 2012-51005 | A | | 3/2012 |
| JP | 2013-174004 | A | | 9/2013 |
| JP | 5569661 | B2 | | 8/2014 |
| WO | WO 2012/160697 | A1 | | 11/2012 |
| WO | WO 2013/012006 | A1 | | 1/2013 |
| WO | WO 2013/154114 | A1 | | 10/2013 |
| WO | WO 2014/148618 | A1 | | 9/2014 |

OTHER PUBLICATIONS

Korean Office Action and partial English translation, dated May 26, 2017, for corresponding Korean Application No. 10-2016-7008176.
International Search Report, issued in PCT/JP2014/073970, dated Nov. 4, 2014.
Written Opinion of the International Searching Authority, issued in PCT/JP2014/073970 (PCT/ISA/237), dated Nov. 4, 2014.
Office Action dated May 20, 2019 in corresponding Indian Patent Application No. 201617005821 (with English translation).
Office Action dated Aug. 23, 2019 in corresponding Thai patent application No. 1601001830 (with English Statement of Relevance).
Indonesian Office Action for Indonesian Application No. P00201602265, dated Nov. 19, 2019, with English translation.
Brazilian Office Action, dated Dec. 17, 2019, for corresponding Brazilian Application No. BR 112016006797-5, along with an English translation.

* cited by examiner (a)

II - II CROSS SECTION (b)

--Prior Art--

(a)

(b)

METHOD AND PRESS-FORMING APPARATUS FOR MANUFACTURING STRUCTURAL MEMBER FOR AUTOMOTIVE BODY

TECHNICAL FIELD

The present invention relates to a method and a press-forming apparatus for manufacturing a structural member for an automotive body, and more particularly to a method and a press-forming apparatus for manufacturing a structural member for an automotive body as a press-formed product made of a steel sheet.

BACKGROUND ART

An automotive body is generally formed of structural members mainly including vehicle longitudinal members that are disposed along a vehicle longitudinal direction and vehicle widthwise members that are disposed along a vehicle widthwise direction. The structural members such as vehicle longitudinal members and vehicle widthwise members, each of which is connected to other members by a flange that is formed at either end of each structural member, ensure the rigidity required for the automotive body, and bear the load.

The structural member for the automotive body requires, for example, a high deformation tolerance against the load acting along the axial direction of the structural member, and a high torsional rigidity. A thinner high-tensile steel sheet having high strength, for example, high tensile strength (high-strength steel sheet or high tensile strength steel sheet), has been increasingly used in recent years as a material for such a structural member in an aim to reduce automotive body weight and improve collision safety. For heavy automobiles such as trucks, however, structural members made of steel sheets of large thickness may be used.

For example, a floor cross member, which is used as a structural member to reinforce a floor of an automotive body, has a cross section substantially shaped like a gutter and is connected to side sills or other vehicle longitudinal members via outward flanges formed at both ends of the floor cross member. It is important for such a floor cross member to have an increased bonding strength with other members and an increased torsional rigidity to ensure the automotive body rigidity and better load transfer property in a case where an impact load is applied.

Patent Literatures 1 to 3 disclose manufacturing methods for structural members for automotive bodies to eliminate defects in the shape fixation of press formed products using high strength materials by getting creative with pad mechanisms used in dies. The manufacturing methods described in these Patent Literatures have attempted to improve in shape fixability after press forming by intentionally generating deflection of a material during forming depending on the positional relationship between the top of a punch and a flat pad of only a part that faces a flat part of the top of the punch.

Further, Patent Literature 4 discloses a flange-shaping die for shaping a flange in an end of a panel product for an automotive body. The flange shaping die can shape a center flange continuing to a center wall and a sideward-protruding flange continuing to a side wall by using the same die in one-time step. Patent Literature 4 also discloses an example in which a blank material is folded while a portion of the blank material to be formed into the center wall is held by a pad.

PRIOR ART LITERATURES

Patent Literatures

[Patent Literature 1] JP 4438468B
[Patent Literature 2] JP 2009-255116A
[Patent Literature 3] JP 2012-051005A
[Patent Literature 4] JP H5-23761A

SUMMARY OF THE INVENTION

Problem(s) to be Solved by the Invention

In order to improve the automotive body rigidity and the load transfer property while an impact load is applied, it is preferable that an outward flange to be formed in an end of a structural member is a continuous flange, and the structural member is jointed to another member via the continuous flange. In other words, it is preferable, as will be described later, that the outward flange is formed also on a peripheral part of a ridge of the structural member so that the outward flange is formed continuously over the ridge and also over at least a part of a gutter bottom and a vertical wall in an end of the structural member.

However, a high-tensile steel sheet, which has a low ductility as compared to a low strength steel sheet such as a mild steel sheet, poses a problem of fracturing during press forming. In addition, a large pressing load is required to press form the high-tensile steel sheet or a steel sheet having a large thickness. It is not easy, however, to increase the pressing load to be able to exert a sufficient tensile force on a forming material. Another problem occurring in press forming the forming material made of the high-tensile steel sheet or the steel sheet having a large thickness is that wrinkles are generated easily.

For the above reasons, forming an outward continuous flange in an end of the structural member using conventional press forming methods tends to generate extension cracks at the edge of a ridge flange and wrinkles in the vicinity of the base of the ridge flange during press forming. Consequently, it has been difficult to obtain a desired shape as an outward continuous flange by using press forming methods known in the art.

As described above, it is difficult to manufacture a structural member having an outward continuous flange from a forming material such as a high-tensile steel sheet or a thick steel sheet without generating the aforementioned wrinkles and cracks because of the technical constraints in the press forming. Consequently, at present, a notch has had to be provided in place of a ridge flange to compensate such difficulty in press forming. Such a notch has been a cause to deteriorate properties such as torsional rigidity and load transfer property.

From this point of view, known techniques disclosed in Patent Literatures 1 to 4 do not take into account formation of an outward continuous flange while suppressing the generation of cracking in the edge of the ridge flange or wrinkling near the base of the ridge flange during the press forming. Consequently, it is still difficult, by using known techniques disclosed in Patent Literatures 1 to 4, to carry out press forming of a structural member that is made of a high-strength steel sheet or high-tensile steel sheet, and that has a substantially gutter-shaped cross section and an outward continuous flange of desired shape in an end.

Incidentally, the term "outward flange" as used herein refers to a flange formed in the way that an end of a press formed product having a substantially gutter-shaped cross section is bent outwardly from the gutter. The term "outward continuous flange" refers to an outward flange continuously formed over the ridge and also over at least a part of the gutter bottom and the vertical wall in the end of the press formed product. Further, the term "ridge flange" as used herein refers to a flange formed on the periphery of the ridge in the outward continuous flange.

Furthermore, the phrase "provide a notch in a flange" as used herein is meant to provide a notch formed in the whole width direction of the flange, which makes the flange discontinuous. The term "the width of a flange" is used to have the same meaning as the height of the flange. When the width of the flange is made small partially but a part of the flange still remains, the notch is not meant to be provided in the flange.

An object of the present invention is to provide a method and a press-forming apparatus for manufacturing a structural member for an automotive body, which can reduce the generation of cracking in the edge of the ridge flange and wrinkling near the base of the ridge flange and can suppress an increase in the pad load, while press forming the structural member that is made of a high-tensile steel sheet or a thick steel sheet and that has a substantially gutter-shaped cross section and an outward continuous flange in an end of the structural member.

Means for Solving the Problem(s)

In order to solve the problems, according to an aspect of the present invention, there is provided a method for manufacturing a structural member for an automotive body, the structural member being formed by pressing a forming material made of a steel sheet by using a press-forming apparatus having a punch, a die, and a pad facing the punch, the structural member extending in a predetermined direction, having a substantially gutter-shaped cross section intersecting the predetermined direction, and including a gutter bottom, a ridge continuing to the gutter bottom, a vertical wall continuing to the ridge, and an outward continuous flange being continuously formed along at least one end in the predetermined direction, the one end at least including a part of the ridge, a part of the gutter bottom, and a part of the vertical wall, the method including: a first step in which the pad presses the forming material against the punch to raise a portion corresponding to a flange to be formed in ends of at least the gutter bottom and the ridge in a direction opposite to the pressing direction, and the punch and the die carry out press forming to form an intermediate product, while the pad bends an end of a portion to be formed into the ridge in the pressing direction and restrains at least a part of the end, and a region other than an end in a portion to be formed into the gutter bottom remains unrestrained; and a second step in which the intermediate product is further pressed to form the structural member for the automotive body.

At least a part of the end of the portion to be formed into the gutter bottom may be unrestrained in the first step.

The whole portion to be formed into the gutter bottom and at least a part of the portion corresponding to the flange to be formed in the end of the gutter bottom, the part continuing to the portion to be formed into the gutter bottom, may remain unrestrained in the first step.

A portion of at least ½ length of a perimeter of a cross section in the end of the portion to be formed into the ridge, the ½ length starting from a border between the portion to be formed into the ridge and the portion to be formed into the gutter bottom, may remain unrestrained in the first step.

The punch used in the first step may have a shoulder having a surface for forming the ridge, and at least a portion of the shoulder corresponding to the end in the predetermined direction may have a curvature radius ranging from 2 mm to 45 mm.

The steel sheet may be a steel sheet of 2.3 mm or more in thickness or a high-tensile steel sheet of 440 MPa or more in tensile strength.

In order to solve the problems, according to another aspect of the present invention, there is provided a press-forming apparatus used for manufacturing a structural member for an automotive body, the structural member extending in a predetermined direction, having a substantially gutter-shaped cross section intersecting the predetermined direction, and including a gutter bottom, a ridge continuing to the gutter bottom, a vertical wall continuing to the ridge, and an outward continuous flange being continuously formed along at least one end in the predetermined direction, the one end at least including a part of the ridge, a part of the gutter bottom, and a part of the vertical wall, the press-forming apparatus including: a punch; a die; and a pad facing the punch, the punch and the die carrying out press forming while the pad and the punch restraining a forming material made of a steel sheet. The pad presses the forming material to bend an end of a portion to be formed into the ridge in the pressing direction, and restrains at least a part of the end while a region other than an end in a portion to be formed into the gutter bottom remains unrestrained.

The pad may leave at least a part of the end of the portion to be formed into the gutter bottom unrestrained.

The pad may leave unrestrained the whole portion to be formed into the gutter bottom and at least a part of the portion corresponding to the flange to be formed in the end of the gutter bottom, the part continuing to the portion to be formed into the gutter bottom.

The pad may leave unrestrained a portion of at least ½ length of a perimeter of a cross section in the end of the portion to be formed into the ridge, the ½ length starting from a border between the portion to be formed into the ridge and the portion to be formed into the gutter bottom.

The punch may have a shoulder having a surface for forming the ridge, and at least a portion of the shoulder corresponding to the end in the predetermined direction may have a curvature radius ranging from 2 mm to 45 mm.

[Effect(s) of the Invention]

During press forming in the first step according to the present invention, an end of the portion to be formed into the ridge is bent, and then restrained, by the pad while the region other than the end of the portion to be formed into a gutter bottom remains unrestrained. Consequently, the load per unit area applied to the area restrained by the pad increases without increasing the pad load. In this way, the end of the portion to be formed into the ridge is securely restrained by the pad, and the end of the ridge is formed by projecting outward the steel sheet material in the region that is pressed by the pad. This results in restraining the movement of the steel sheet material in the area surrounding the region pressed by the pad, and also suppressing an increase in the pad load, while obtaining the press formed product that restrains the generation of cracks at the edge of the outward continuous flange and wrinkles in the vicinity of the base of the outward continuous flange.

The structural member manufactured by the press forming, which has a substantially gutter-shaped cross section and an outward continuous flange formed in the end thereof and is made of a high-tensile steel sheet or a thick steel sheet, can exhibit an improved torsional rigidity and load transfer property, thanks to having an outward continuous flange of desired shape. In addition, such structural member can join to other members using the whole area of the outward continuous flange including the ridge flanges, which leads to a large increase in the strength and rigidity of a jointed structure including the structural member. Consequently, this expands the possibility of applying steel sheets, for example, steel sheets having a thickness of 2.3 mm or more or having a tensile strength of 440 MPa or more, to structural members for automotive bodies.

BRIEF DESCRIPTION OF THE DRAWING(S)

Figure 5:
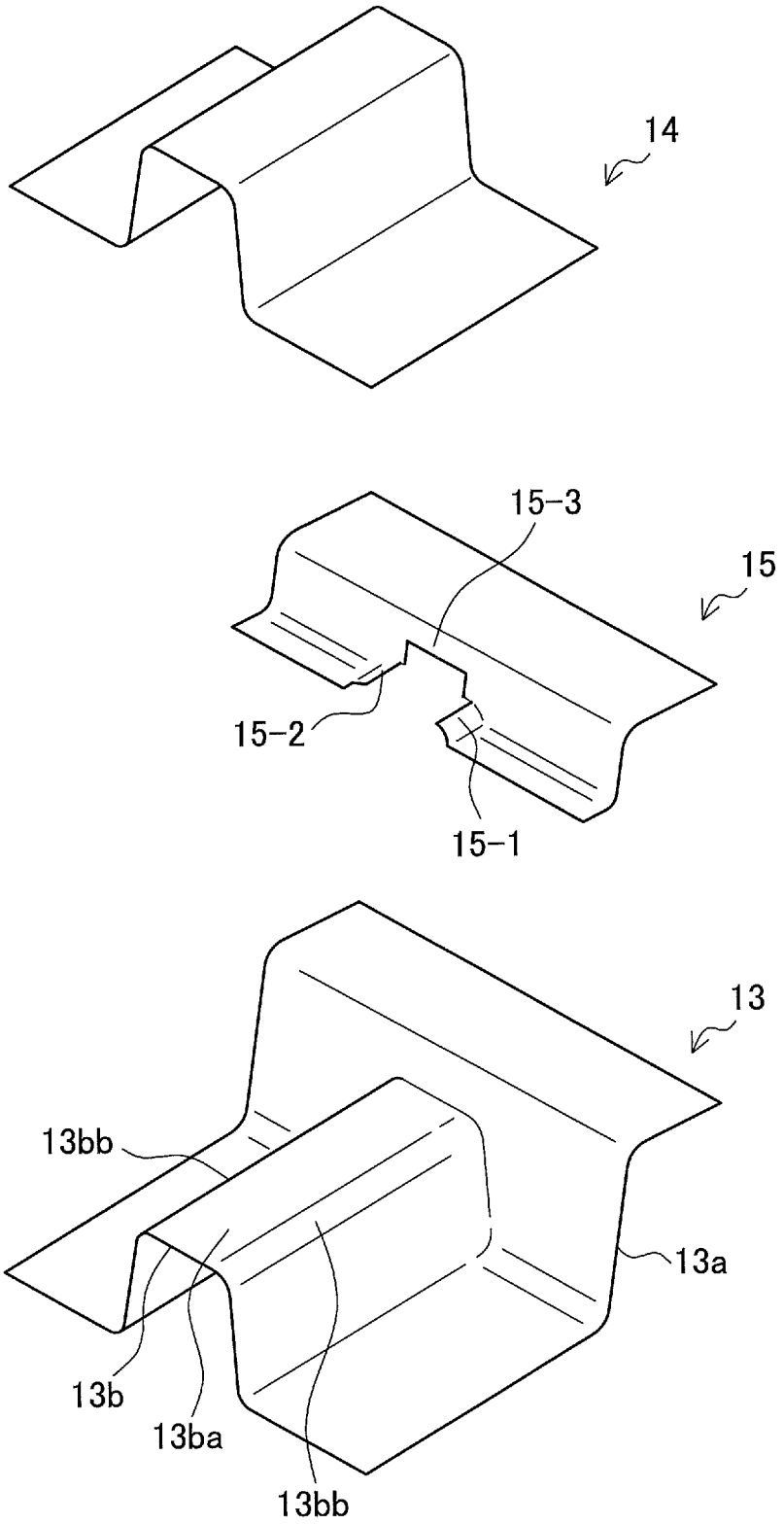

FIG. 5 a perspective view illustrating a schematic structure of a press-forming apparatus according to the present embodiment.

Figure 6:
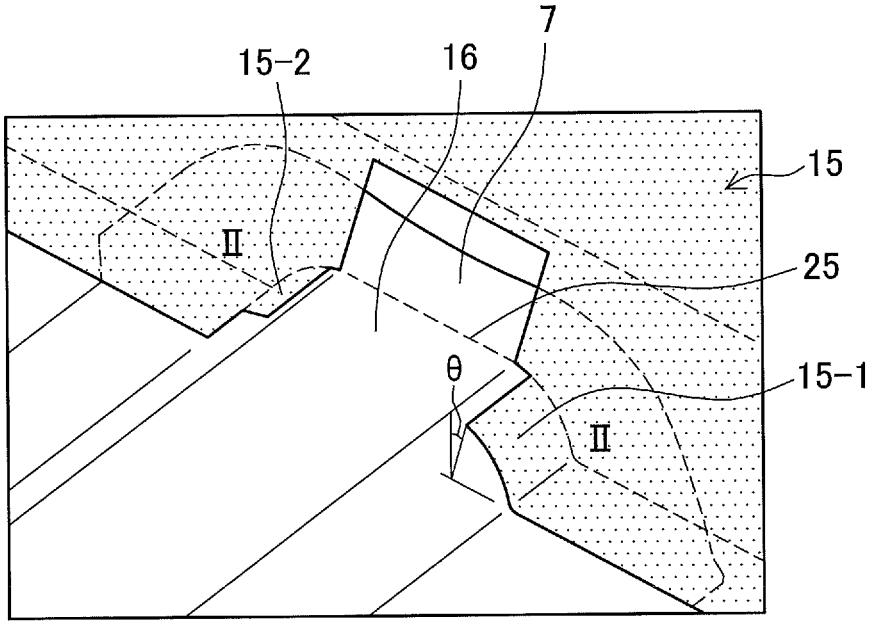
Figure 6:
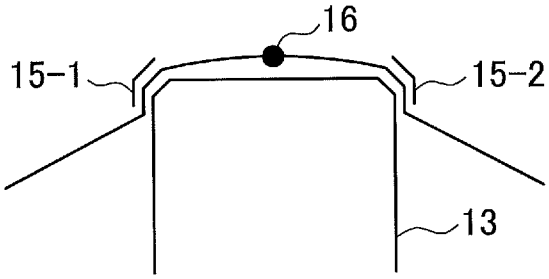

FIG. 6 (*a*) is a perspective view schematically illustrating a state of a forming material restrained by a ridge pad, and FIG. 6(*b*) is a schematic view illustrating a state of a forming material restrained by a ridge pad.

Figure 7:
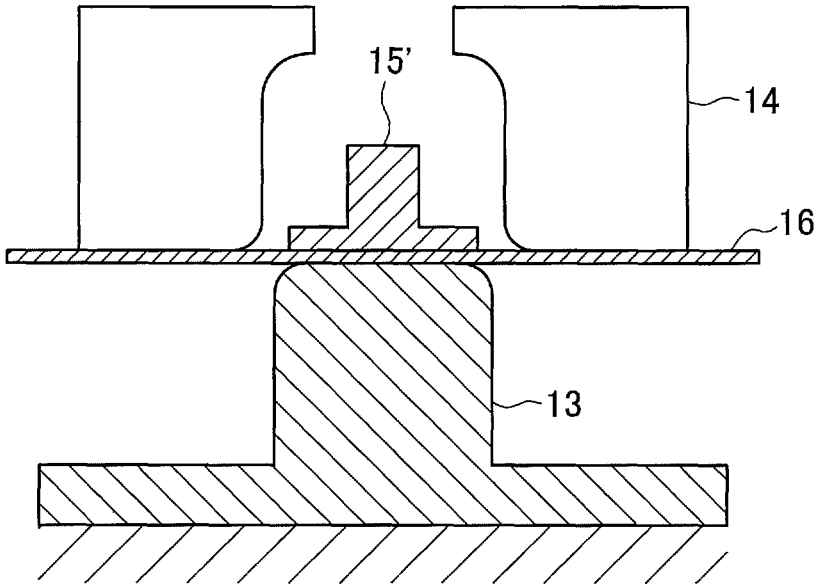
Figure 7:
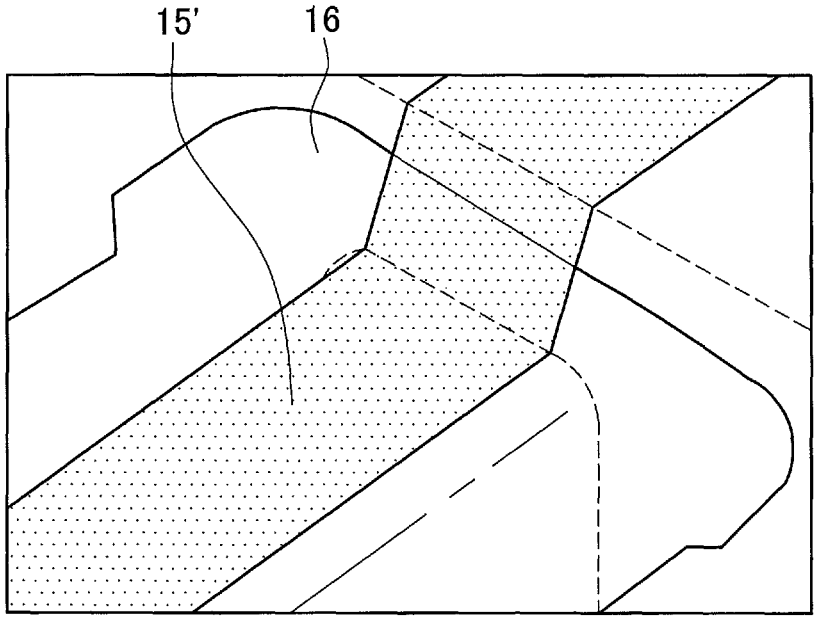

FIG. 7 (*a*) is a sectional view schematically illustrating a state of a forming material restrained by a pad known in the art, and FIG. 7(*b*) is a sectional view schematically illustrating a state of a forming material restrained by a pad known in the art.

Figure 8:
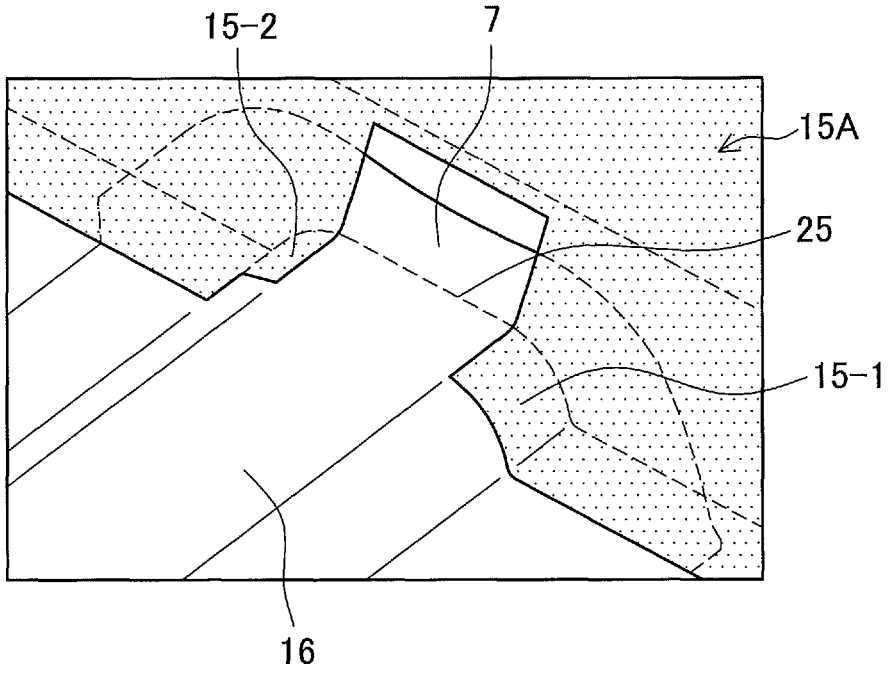

FIG. 8 is a perspective view illustrating a state in which a whole portion to be formed into a ridge in the vicinity of an outward flange is restrained.

Figure 9:
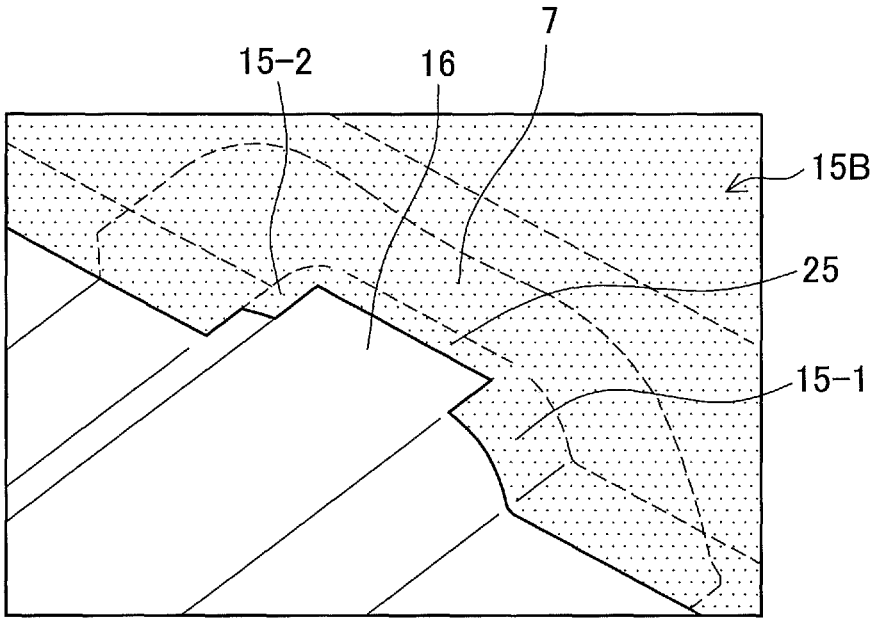

FIG. 9 is a perspective view illustrating a state in which a curved surface rising from a gutter bottom to an outward flange is restrained.

Figure 10:
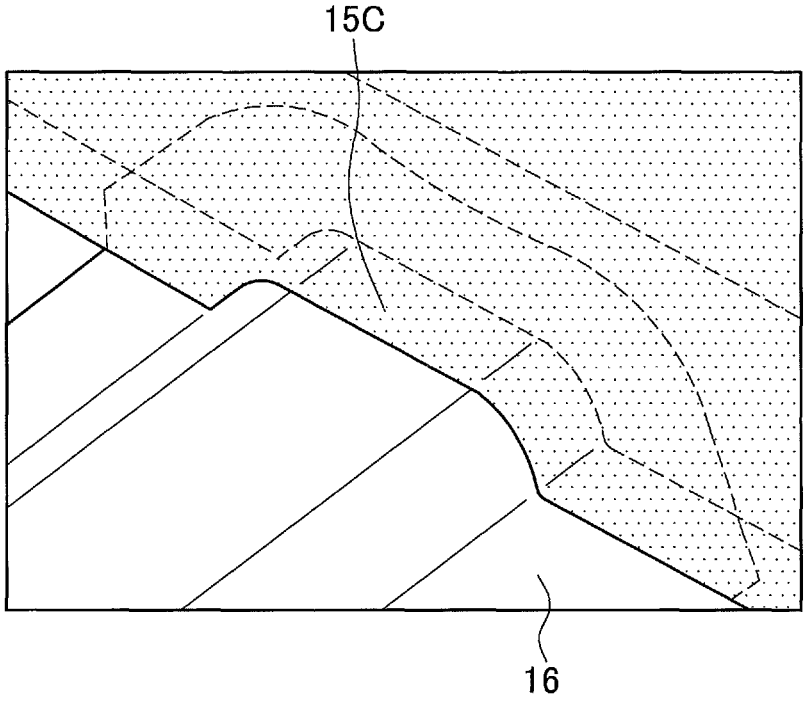

FIG. 10 is a perspective view illustrating a state in which a whole gutter bottom in the vicinity of an outward flange is restrained.

Figure 11:
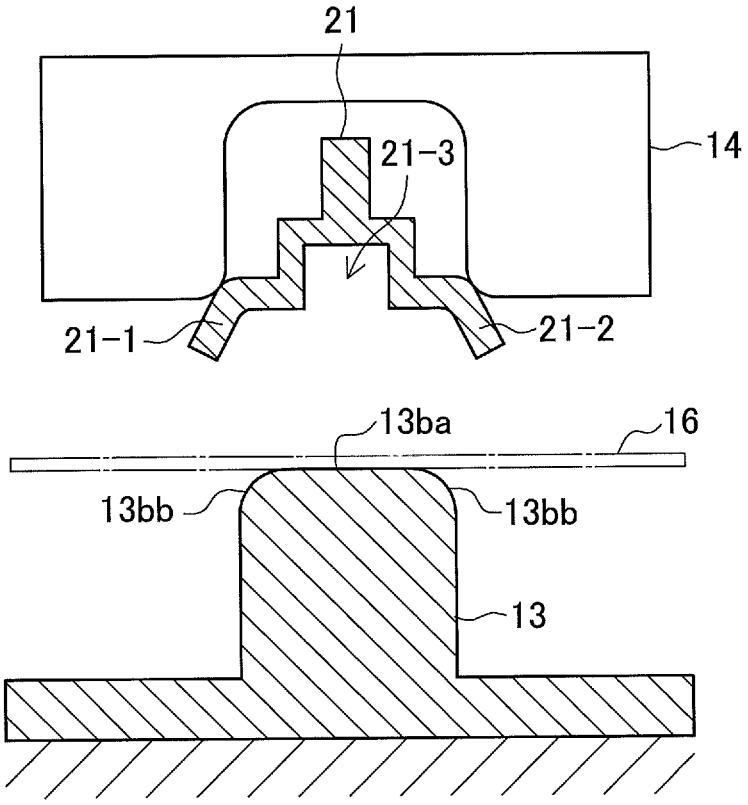

FIG. 11 is a sectional view illustrating another structure example of the ridge pad.

Figure 12:
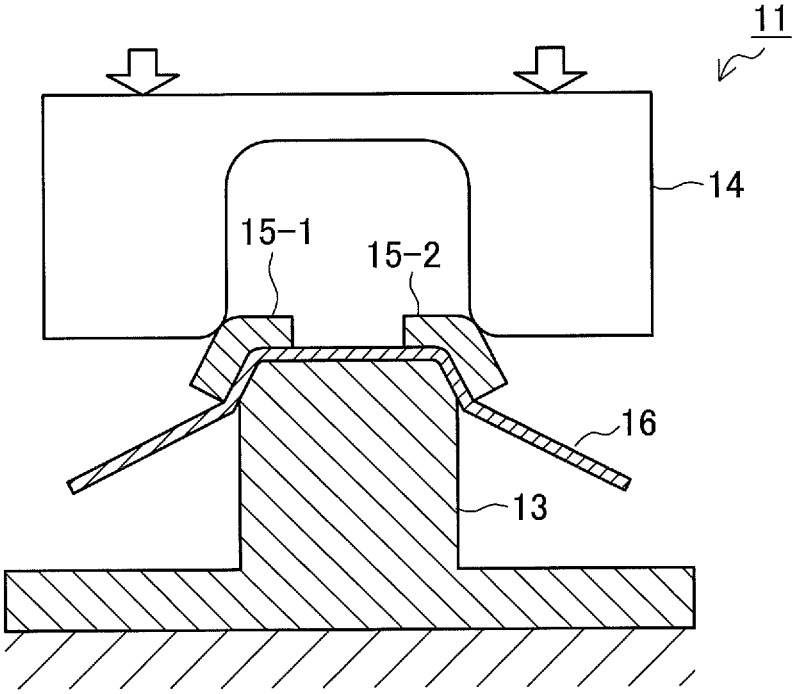

FIG. 12 is a schematic view illustrating a step in which a ridge pad restrains a forming material.

Figure 13:
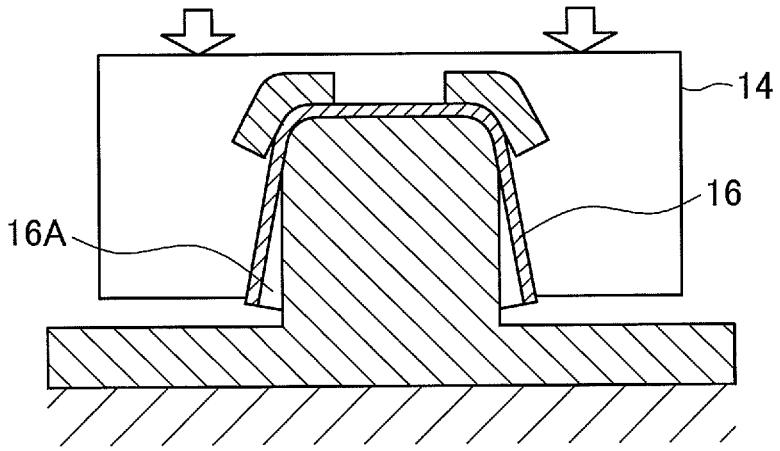

FIG. 13 is a schematic view illustrating a step in which a die presses a forming material.

Figure 14:
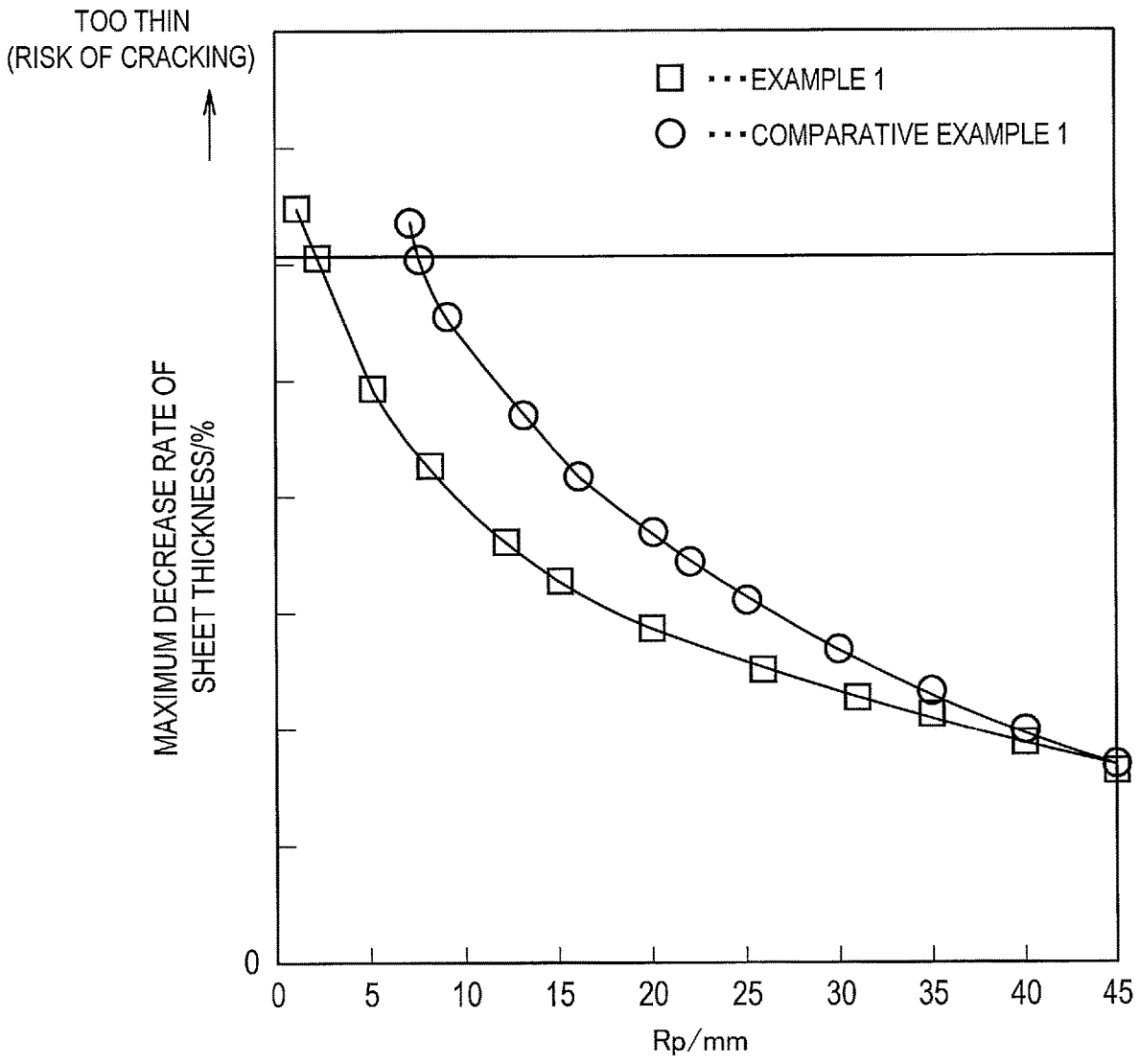

FIG. 14 is a characteristic diagram illustrating a relationship between a curvature radius of a shoulder of a punch and a maximum value in a decrease rate of sheet thickness of a ridge flange.

MODE(S) FOR CARRYING OUT THE INVENTION

Hereinafter, a preferred embodiment of the present disclosure will be described in detail with reference to the appended drawings. In this specification and the appended drawings, structural elements that have substantially the same function and structure are denoted with the same reference numerals, and repeated explanation of these structural elements is omitted.

<1. Structural Member for Automotive Body>

A method and a press-forming apparatus for manufacturing a structural member for an automotive body according to an embodiment of the present invention are provided to manufacture a structural member having an outward continuous flange of desired shape. Accordingly, a structural member manufactured according to the present embodiment will be first explained.

Figure 1:
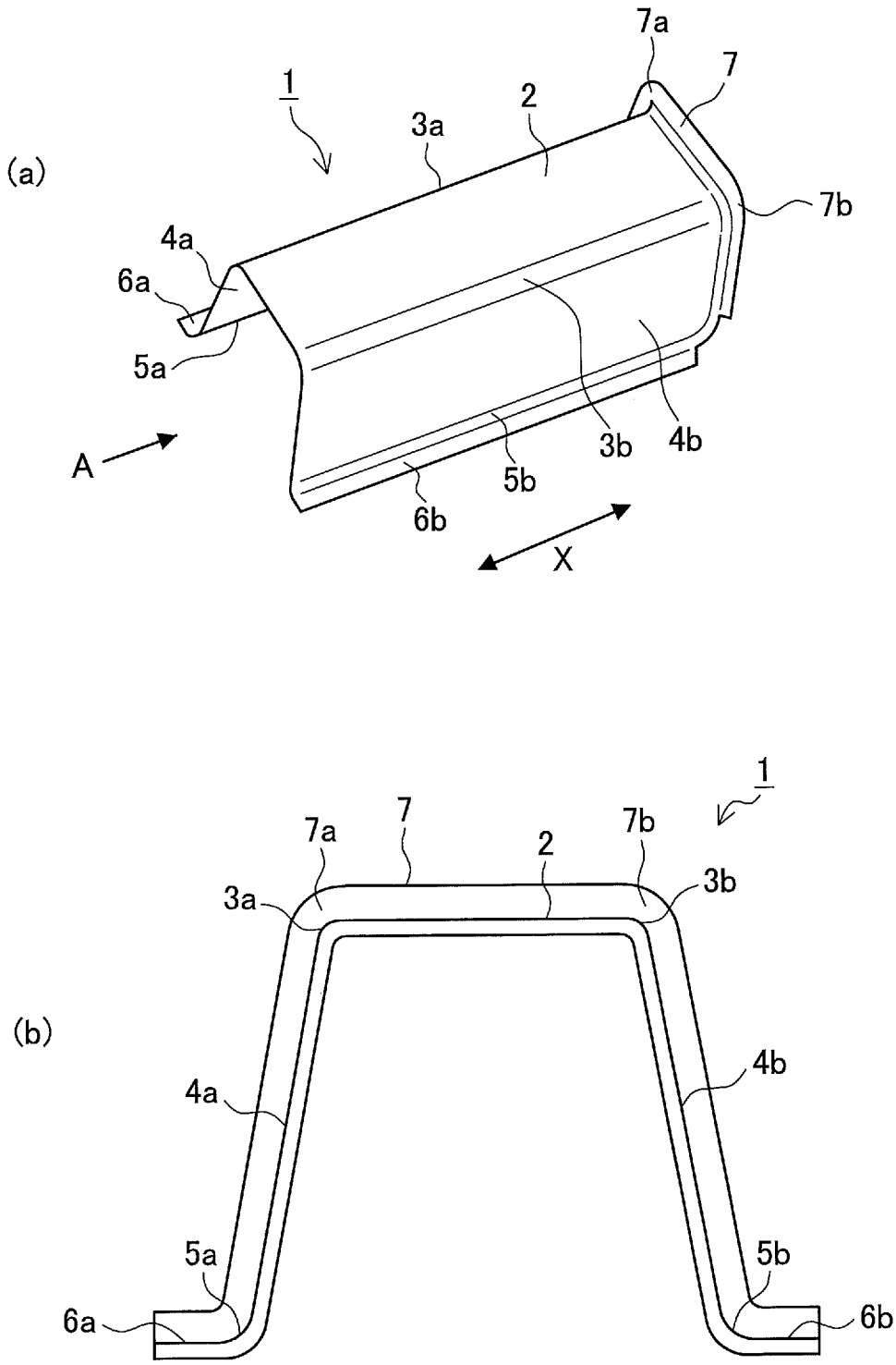
FIG. 1 (*a*) is a perspective view illustrating an example of a structural member to be manufactured using a method and a press-forming apparatus for manufacturing a structural member for an automotive body according to an embodiment of the present invention, and FIG. 1 (*b*) is a view on the arrow A in FIG. 1 (*a*).

FIG. 1 illustrates an example of a structural member 1 to be manufactured using a method and a press-forming apparatus for manufacturing a structural member for an automotive body according to the present embodiment. FIG. 1 (*a*) is a perspective view and FIG. 1(*b*) is a view on the arrow A in FIG. 1 (*a*), both of which illustrate the structural member 1. The structural member 1 is formed extending in a predetermined direction designated by the arrow X in FIG. 1 (*a*) (which is a direction substantially perpendicular to the plain of the paper of FIG. 1(*b*), in other words, an axial direction). The structural member 1 is a press formed product made of a high-tensile steel sheet and having a sheet thickness of 2.3 mm or more and a tensile strength of 440 MPa or more measured by tensile testing in accordance with JIS Z 2241. The structural member 1 illustrated in FIG. 1 (*a*) has a predetermined direction that is the longitudinal direction of the structural member 1. The predetermined direction, however, is not limited to the longitudinal direction of the structural member 1.

The structural member 1 is used, for example, as a floor cross member, a side sill, a front side member, a floor tunnel brace, or as a part of these members. When the structural member 1 is used as a reinforcement member for the floor cross member, the side sill, the front side member, the floor tunnel or other members, a high-strength steel sheet having a tensile strength preferably of 590 MPa or more, and more preferably of 780 MPa or more, is used as a forming material.

As illustrated in FIG. 1, the structural member 1 has a substantially hat-shaped cross section and includes a gutter bottom 2, ridges 3*a*, 3*b* continuing to the gutter bottom 2, vertical walls 4*a*, 4*b* continuing to the ridges 3*a*, 3*b*, curved sections 5*a*, 5*b* continuing to the vertical walls 4*a*, 4*b*, and flanges 6*a*, 6*b* continuing to the curved sections 5*a*, 5*b*. The substantially hat-shaped cross section is a mode of a substantially gutter-shaped cross section. The two ridges 3*a*, 3*b* are continuously formed at both ends of the gutter bottom 2 in the width direction. The two vertical walls 4*a*, 4*b* are formed continuing to the two ridges 3*a*, 3*b*, respectively. The two curved sections 5*a*, 5*b* are formed continuing to the two vertical walls 4*a*, 4*b*, respectively. The two flanges 6*a*, 6*b* are formed continuing to the two curved sections 5*a*, 5*b*, respectively. The curved sections 5*a*, 5*b* continuing to the vertical walls 4*a*, 4*b* and the flanges 6*a*, 6*b* continuing to the curved sections 5*a*, 5*b* may be omitted in the structural member 1 that is manufactured using a method and a press-forming apparatus for manufacturing a structural member for an automotive body according to the present embodiment.

An outward continuous flange 7 is formed on the periphery of a longitudinal end of the structural member 1 along the gutter bottom 2, the ridges 3*a*, 3*b*, and the vertical walls 4*a*, 4*b*. The structural member 1 is a press formed product having the ridge flanges 7*a*, 7*b* and not having notches in portions corresponding to the periphery of the ridges 3*a*, 3*b*, which is different from press formed products known in the art. Since the structural member 1 includes the outward continuous flange 7, the structural member 1 can join to other members also at the ridge flanges 7*a*, 7*b* using spot welding or the like. Consequently, this increases torsional rigidity when a load in an axial rotational direction is applied to the structural member 1. The outward continuous flange 7 included in the structural member 1 alleviates stress concentration in the ends of the ridges 3*a*, 3*b* when an axial load is applied to the structural member 1. This improves the load transfer property of the structural member 1.

As used herein, the term "end in the predetermined direction (longitudinal direction or axial direction)" is meant to include a curved rising surface between the outward continuous flange 7 and the gutter bottom 2, the ridges 3*a*, 3*b*, and the vertical walls 4*a*, 4*b*, etc., and also include a region within a flange-width length along the predetermined direction from the border with the outward continuous flange 7.

The flange width of the outward continuous flange 7 is preferably 2 mm or more in the region that is not jointed to connection with another member. For the region that is jointed to connection with another member using spot welding, laser welding, etc., the flange width of the outward continuous flange 7 is preferably 10 mm or more, and more preferably 15 mm or more. According to a method for manufacturing a structural member for an automotive body of the present embodiment, a structural member 1 of desired shape having the outward continuous flange 7 can be obtained even though the flange width is made larger. The flange width of the outward continuous flange 7 can be suitably adjusted by modifying the shape of a developed blank (a forming material) 16, which will be described later.

Figure 2:
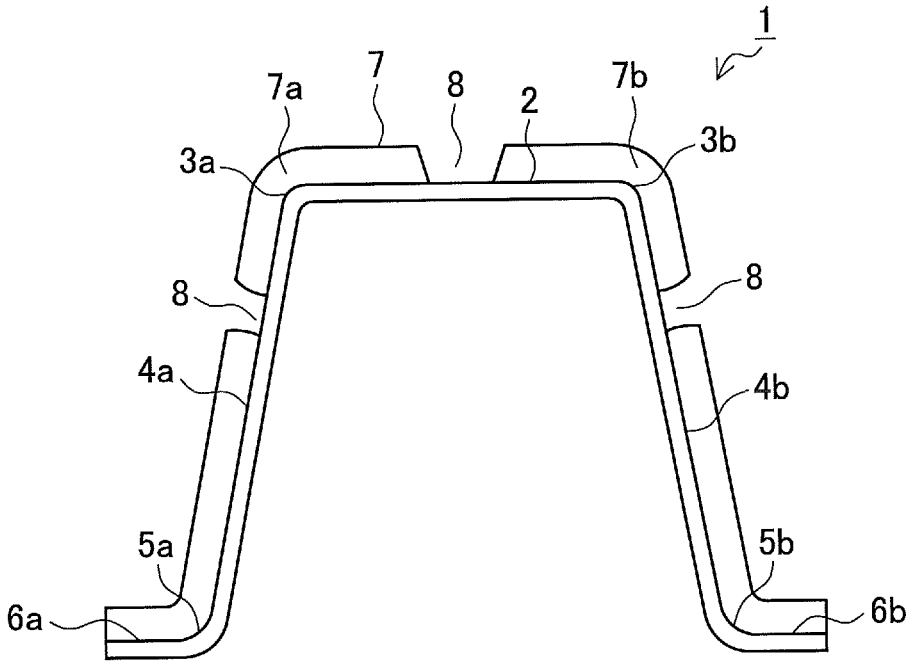
FIG. 2 illustrates an example of a structural member having notches in an outward flange provided at a gutter bottom and a vertical wall.

The structural member 1 in FIG. 1 is a press formed product having a substantially hat-shaped cross section. The cross sectional shape of the structural member 1, however, is not limited to the shape like a hat. A method and a press-forming apparatus for manufacturing a structural member for an automotive body according to the present embodiment is applicable to manufacturing of a press formed product that has at least a gutter bottom 2, ridges 3*a*, 3*b*, and vertical walls 4*a*, 4*b*, and also has an outward continuous flange 7 in the end in the predetermined direction. The outward continuous flange 7 of the structural member 1 in FIG. 1 is continuously formed along the whole periphery of the end in the longitudinal direction. However, it may be discontinuous in portions corresponding to the peripheries of the gutter bottom 2 or the vertical walls 4*a*, 4*b*. As shown in FIG. 2, for example, notches 8 may be provided in a part of the flange along the gutter bottom 2 and the vertical walls 4*a*, 4*b*.

A forming material of the structural member 1 is not limited to a steel sheet having a thickness of 2.3 mm or more or a tensile strength of 440 MPa or more. The steel sheet may have a thickness of less than 2.3 mm or a tensile strength of less than 440 MPa. However, a method and a press-forming apparatus for manufacturing a structural member for an automotive body according to the present embodiment is especially effective when the forming material is a steel sheet having a thickness of 2.3 mm or more or a steel sheet having a tensile strength of 440 MPa or more that are difficult to be formed into a desired shape by using pressing methods known in the art. Although upper limits of sheet thickness and tensile strength are not specified, typical upper limits of sheet thickness and tensile strength are about 15 mm and about 1310 MPa.

Figure 3:
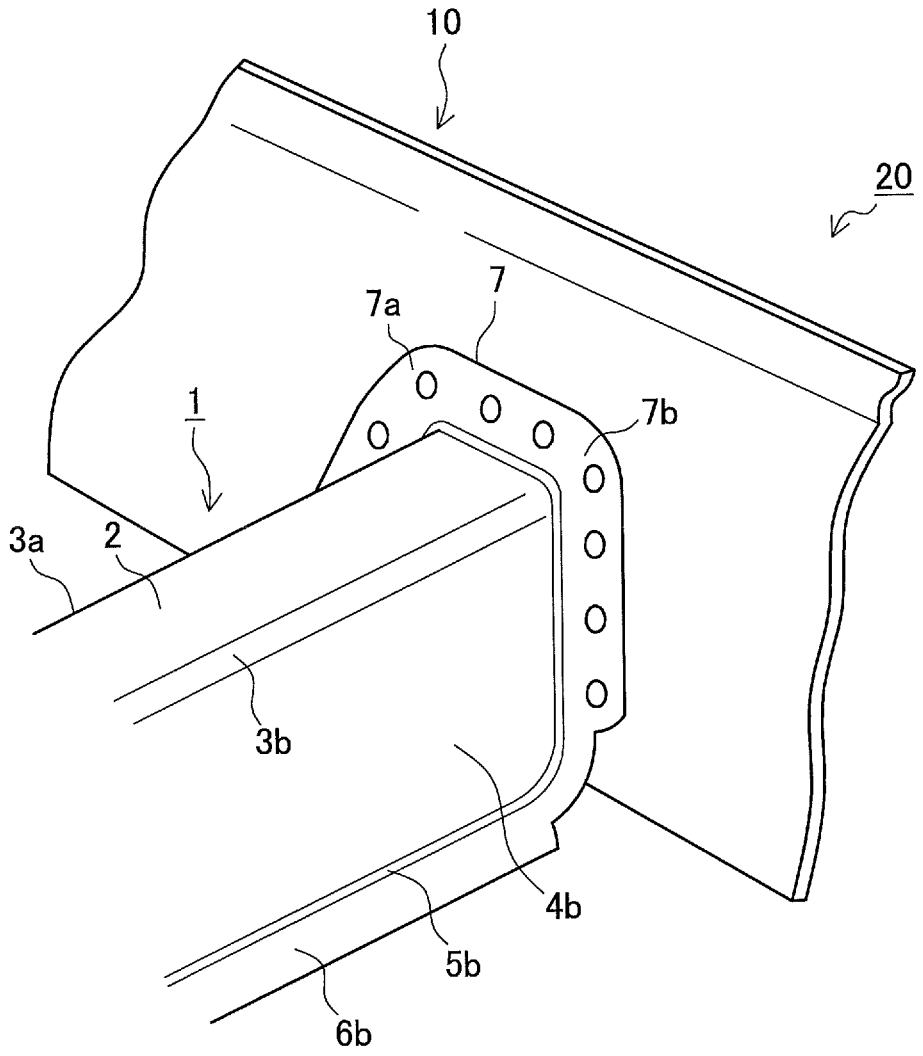
FIG. 3 is a schematic view illustrating a jointed structure.

The structural member 1 can be jointed to another member via the outward continuous flange 7 formed in the end of the structural member 1, and then the structural member 1 can be used as a jointed structure. FIG. 3 illustrates a structure example of a jointed structure 20. The jointed structure 20 is formed of the structural member 1 that is spot-welded to another steel sheet member 10 via the outward continuous flange 7 formed in the end of the structural member 1. In the jointed structure 20, the flange width of the outward continuous flange 7 of the structural member 1 is 10 mm or more. The jointed structure 20 is spot-welded at a plurality of spots, which are equally spaced with each other, over the whole outward continuous flange 7. Consequently, the jointed structure 20 has an increased strength in the joint, and provides an excellent torsional rigidity and an excellent load transfer property along the axial direction of the structural member 1.

Incidentally, although the structural member 1 illustrated in FIG. 1 has an outward continuous flange 7 at one end in the longitudinal direction, the structural member 1 may have the outward continuous flanges 7 at both ends in the longitudinal direction.

<2. Method and Press-forming Apparatus for Manufacturing Structural Member for Automotive Body>

Next, a method and a press-forming apparatus for manufacturing a structural member for an automotive body according to the present embodiment are described. As described in the foregoing, a method and a press-forming apparatus for manufacturing a structural member for an automotive body according to the present embodiment are the method and the apparatus that are used to manufacture the structural member 1 having the outward continuous flange 7 formed on at least one end in the predetermined direction as illustrated in FIG. 1. Now, a method for manufacturing a structural member for an automotive body will be outlined hereafter, and then details of a method and a press-forming apparatus for manufacturing a structural member for an automotive body according to the present embodiment are described.

(2-1. Outline of Manufacturing Method)

A method for manufacturing a structural member for an automotive body according to the present embodiment will now be outlined. The manufacturing method of a press formed product according to the present embodiment includes a first step using a first press-forming apparatus and a second step using a second press-forming apparatus.

The first step is carried out using the first press-forming apparatus. The first press-forming apparatus corresponds to a press-forming apparatus according to the present embodiment, which will be described later. In the first step, a pad presses a forming material against a punch so that a portion corresponding to a flange, which will be formed at least in ends of the gutter bottom and the ridges, is raised in an opposite direction to the pressing direction. In addition, the pad bends the end of the portion to be formed into the ridge in the pressing direction, and at least a part of the end is restrained. A region other than the end in the end of the portion to be formed into a gutter bottom is made unrestrained. With the forming material being restrained by the pad, the punch and die carry out press forming to form an intermediate product.

The second step is carried out using a second press-forming apparatus, which is different from the first press-forming apparatus. In the first step, the pad restrains at least the end of the ridge so that a portion below the pad in the pressing direction remains unformed. Accordingly, the structural member is formed by pressing the intermediate product using the second press-forming apparatus in the second step.

The second press-forming apparatus may be a type of machine capable of pressing what has remained unformed by the first press-forming apparatus. In particular, the second press-forming apparatus may be a type of machine capable of pressing the portion that has not been pressed by the pad and the die among portions to be formed into the gutter bottom, the ridges, and the vertical wall. Further, the second press-forming apparatus may be a type of machine that presses a portion of the outward continuous flange that has not been formed by the first press-forming apparatus. A known press-forming apparatus having a die and punch can be used as such second press-forming apparatus.

(2-2. Press-Forming Apparatus)

Figure 4:
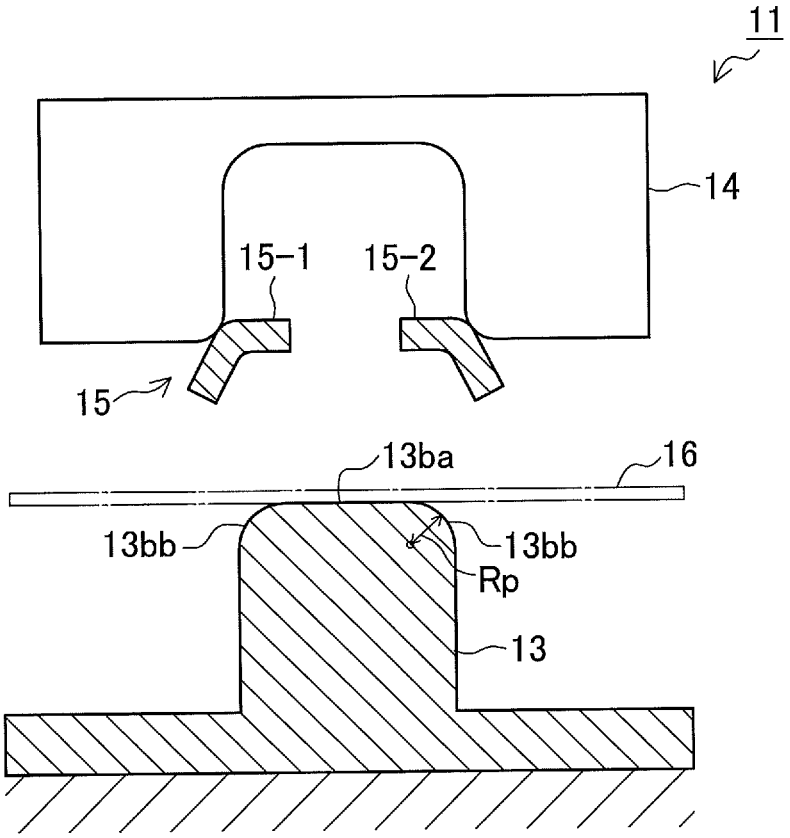
FIG. 4 is a sectional view outlining a schematic structure of a press-forming apparatus according to the present embodiment.

Now, the press-forming apparatus according to the present embodiment will be described. As described in the foregoing, the press-forming apparatus according to the present embodiment is the first press-forming apparatus used in the first step to form the intermediate product. FIG. 4 and FIG. 5 schematically illustrates a structure example of a press-forming apparatus 11 according to the present embodiment. FIG. 4 is a sectional view outlining a part of the first press-forming apparatus 11 that forms the end region of the structural member 1. FIG. 4 illustrates a state in which a forming material 16 is placed on a punch 13 before press forming starts. FIG. 5 is an exploded perspective view outlining a structure of the first press-forming apparatus 11. Further, FIG. 6 (*a*) and FIG. 6 (*b*) are a perspective view and a sectional view, both of which schematically illustrate a state in which the forming material 16 is restrained by a pad 15.

The first press-forming apparatus 11 has a punch 13, a die 14, and a pad 15 that presses a forming material 16 against the punch 13 and restrains the forming material 16. The first press-forming apparatus 11 is basically configured to press the forming material 16 by moving the die 14 to the punch 13 with the forming material 16 being restrained by the pad 15 and the punch 13.

The punch 13 has a punch surface 13*b* having a shape corresponding to a substantially gutter-shaped cross section of the structural member 1 to be formed, and a side wall 13*a* disposed at a longitudinal end of the punch 13. The punch surface 13*b* has an upper surface 13*ba* and shoulders 13*bb* for forming the ridges. The side wall 13*a* is the part which will form the outward continuous flange 7 by collaborating with a flange forming part 15-3 of the pad 15.

In each shoulder 13*bb* of the punch 13, at least the longitudinal end of the shoulder 13*bb*, which is proximate to the side wall 13*a*, preferably has a curvature radius Rp of 2 mm or more. The curvature radius Rp at the portion of the shoulder 13*bb* being less than 2 mm makes it difficult to disperse the strain generated in the end of each portion to be formed into the ridges 3*a*, 3*b* in the forming material 16 when the end is restrained by the pad 15. In contrast, if the curvature radius Rp at the portion of the shoulder 13*bb* exceeds 45 mm, the strain is relatively alleviated even though a known manufacturing method and a known pressing machine are employed to press the end of each portion to be formed into the ridges 3*a*, 3*b*. Consequently, the press-forming apparatus 11 according to the present embodiment is especially effective in manufacturing the structural member 1 having the ridges 3*a*, 3*b* of which the curvature radius Rp ranges from 2 mm to 45 mm.

The pad 15 has restraining parts 15-1, 15-2, and a flange forming part 15-3. The pad 15 is a partitioned pad in which the restraining parts 15-1, 15-2, which are cut apart along the axial direction of the structural member 1 to be formed, are connected by the flange forming part 15-3. The pad 15 may be formed of two completely-separated restraining parts 15-1, 15-2 without having a flange forming part 15-3.

The restraining parts 15-1, 15-2 are disposed with the parts facing the respective shoulders 13*bb* of the punch 13, and press and restrain the forming material 16 against the shoulders 13*bb* of the punch 13. The portions of the forming material 16 that are restrained by the restraining parts 15-1, 15-2 and the shoulders 13*bb* are formed mainly into the ridges 3*a*, 3*b* in the vicinity of the portions to be formed into the ridge flanges 7*a*, 7*b*. Each of the restraining parts 15-1, 15-2 of the pad 15 presses the end region of the portion to be formed into each ridge 3*a*, 3*b* to allow the steel sheet material in the pressed region to project outward and to form the end of each ridge 3*a*, 3*b* while the movement of the surrounding steel sheet material is reduced. In the description hereinafter, the pad 15 is also referred to as the ridge pad.

The ridge pad 15 according to the present embodiment is configured not to restrain the portion to be formed into the gutter bottom 2 that is located away from the portion to be formed into the outward continuous flange 7. In addition, the ridge pad 15 according to the present embodiment is configured not to restrain the portion to be formed into the gutter bottom 2 also in the vicinity of the portion to be formed into the outward continuous flange 7. In this way, an area of the forming material 16 that the ridge pad 15 restrains is made smaller than an area restrained by known pads, which restrain the most area of the gutter bottom. Consequently, the load per unit area for pressing the end of the portion to be formed into the ridges 3*a*, 3*b* increases without increasing the pad load considerably. Consequently, the movement of the steel sheet material surrounding the end of each portion to be formed into the ridges 3*a*, 3*b* tends to be further reduced.

In addition, the ridge pad 15 according to the present embodiment leaves the end of the portion to be formed into the gutter bottom 2 unrestrained, which induces deflection in the portion to be formed into the gutter bottom 2 while the ends of the portions to be formed into ridges 3*a*, 3*b* are pressed and restrained by the ridge pad 15. This extends the lineal length of the ends of the portions to be formed into the ridges 3*a*, 3*b* and the gutter bottom 2 so that an edge-elongation percentage of each ridge flange 7*a*, 7*b* is reduced and shrinkage deformation near the base of each ridge flange 7*a*, 7*b* is also reduced. Consequently, cracking in the edge of each ridge flange 7*a*, 7*b* and wrinkling near the base of each ridge flange 7*a*, 7*b* are reduced. In particular, the ridge pad 15 according to the present embodiment leaves unrestrained the portion to be formed into the outward continuous flange 7 that continues from the portion to be formed into the gutter bottom 2. This facilitates inducing the deflection and more effectively reduces cracking in the edge and wrinkling near the base of each ridge flange 7*a*, 7*b*.

It is preferable that the restraining of the forming material 16 by the ridge pad 15 is directed to the whole portion or only a part of the portion to be formed into each ridge 3*a*, 3*b* in the vicinity of the portion to be formed into the outward continuous flange 7. As illustrated in FIG. 6 (*a*), the restraining parts 15-1, 15-2 of the ridge pad 15 according to the present embodiment restrain a part of the portions to be formed into the ridges 3*a*, 3*b* in the vicinity of the outward continuous flange 7 in the forming material 16. More particularly, FIG. 6 (*a*) illustrates an example in which there remains an unrestrained portion within an angle θ, along the perimeter of the cross section of each ridge 3*a*, 3*b*, starting from the border between the portion to be formed into each ridge 3*a*, 3*b* and the portion to be formed into the gutter bottom 2. In addition, the ridge pad 15 according to the present embodiment also leaves unrestrained the portion formed into the outward flange 7 that continues from the portion to be formed into the gutter bottom 2.

This facilitates inducing the deflection of the forming material 16 in the portion to be formed into the gutter bottom 2, as illustrated in FIG. 6 (*b*). Accordingly, the lineal length of the cross section of the ends of the portions to be formed into ridges 3*a*, 3*b* and the gutter bottom 2 becomes longer so that an edge-elongation percentage of each ridge flange 7*a*, 7*b* is reduced, and shrinkage deformation near the base of each ridge flange 7*a*, 7*b* is also reduced. Consequently, cracking in the edge and wrinkling near the base of each ridge flange 7*a*, 7*b* are reduced.

In contrast, an extent of a forming material that is restrained by a pad 15' known in the art is illustrated in FIG. 7. FIGS. 7 (*a*) and (*b*) are a sectional view and a perspective view, both of which illustrate a state in which the forming material 16 is restrained by the pad 15' known in the art. As illustrated in FIG. 7, although the known pad 15' restrains the portion to be formed into the gutter bottom 2, it does not restrain the portions to be formed into the ridges 3*a*, 3*b*. Consequently, the material surrounding the portions to be formed into the ridges 3*a*, 3*b* moves easily, which tends to cause edge-elongation cracking in the ridge flanges 7*a*, 7*b* and wrinkling near the base of the ridge flanges 7*a*, 7*b*.

As illustrated in FIG. 8, a ridge pad 15A according to the present embodiment may however restrain the whole perimeter of the cross section of the each portion to be formed into each ridge 3*a*, 3*b* in the vicinity of the portion to be formed into the outward continuous flange 7. As illustrated in FIG. 6 (*a*), the ridge pad 15A is an example in which 0° is provided for the angle θ along the perimeter of the cross section of each ridge 3*a*, 3*b*, starting from the border between the portion to be formed into each ridge 3*a*, 3*b* and the portion to be formed into the gutter bottom 2. The ridge pad 15A provides a sufficiently small restraining area as compared to the known pad 15' illustrated in FIG. 7 and allows for increasing the pad load per unit area and inducing the deflection of the forming material 16.

Further, as illustrated in FIG. 9, the ridge pad 15B according to the present embodiment may restrain the portion to be formed into the outward continuous flange 7 including a curved rising surface continuing from the portion to be formed into the gutter bottom 2. The ridge pad 15B provides a sufficiently small restraining area as compared to the known pad 15' illustrated in FIG. 7 and allows for increasing the pad load per unit area and inducing the deflection of the forming material 16.

It should be noted that the ridge pad 15 is aimed at projecting outward the material for the portions to be formed into the ridges 3*a*, 3*b* in the vicinity of the outward continuous flange 7 and forming the ridges 3*a*, 3*b* so that the movement of the surrounding material is made to reduce. Accordingly, an extent restrained by the ridge pad 15 in the end of the portion to be formed into each ridge 3*a*, 3*b* is preferably at least ⅓ or more of the perimeter length of the cross section of the portions to be formed into each ridge 3*a*, 3*b*. The extent restrained by the ridge pad 15 may further include a part of the vertical walls 4*a*, 4*b* in proximity to the ridges 3*a*, 3*b*.

In addition, by making unrestrained the border between the portion to be formed into each ridge 3*a*, 3*b* and the portion to be formed into the gutter bottom 2 in the ends of the portions to be formed into the ridges 3*a*, 3*b*, it is possible to facilitate inducing the deflection of the gutter bottom 2. Accordingly, the extent that is not restrained by the ridge pad 15 in the ends of the portions to be formed into the ridges 3*a*, 3*b* is preferably at least ½ or more of the perimeter of the cross section starting from the border.

It is also preferable that the longitudinal extent of the portions to be formed into the ridges 3*a*, 3*b* that is restrained by the ridge pad 15 covers the vicinity of the ridge flanges 7*a*, 7*b* or, in other words, at least a part of a predetermined extent from the base of the ridge flanges 7*a*, 7*b*. The predetermined extent can be the same length as the flange width of the ridge flanges 7*a*, 7*b*. In this case, it is not necessary to restrain the portion to be formed into the ridges 3*a*, 3*b* in the whole region covered by the predetermined extent. It is sufficient to restrain only a part of the region covered by the predetermined extent.

Incidentally, from a view point of increasing the pad load per unit area to be applied to the ends of the portions to be formed into the ridges 3*a*, 3*b*, the ridge pad 15 may restrain the portion to be formed into the gutter bottom 2 in the vicinity of the portion to be formed into the outward continuous flange 7. In other words, as illustrated in FIG. 10, a ridge pad 15C according to the present embodiment may restrain the end of the portion to be formed into the gutter bottom 2 as well as at least a part of the portions to be formed into ridges 3*a*, 3*b* in the vicinity of the portion to be formed into the outward continuous flange 7.

The die 14 has a substantially gutter-shaped cross section as a whole. The die 14 illustrated by way of example in FIG. 4 and FIG. 5 is configured to have a press surface corresponding to the portion to be formed into a gutter bottom 2 except the end region that ridge pad 15 does not restrain. Incidentally, the die 14 may be configured not to have the press surface corresponding to the whole portion to be formed into a gutter bottom 2. In other words, the die 14 may be cut into two parts along the axial direction of a press formed product to be formed.

The die 14 is configured not to be overlapped with the ridge pad 15 in the pressing direction. The die 14 is moved toward the punch 13 while the ridge pad 15 restrains the portions to be formed into the ridges 3*a*, 3*b* in the vicinity of the portion to be formed into the outward continuous flange 7, but does not restrain at least a part of the portion to be formed into the gutter bottom 2. In this way, the region including the gutter bottom 2, the ridges 3*a*, 3*b*, the vertical walls 4*a*, 4*b*, and other portions, except the region overlapped by the ridge pad 15 in the pressing direction, is formed by pressing.

The first press-forming apparatus 11 enables press forming of the forming material 16 made of, for example, a steel sheet having a sheet thickness of 2.3 mm or more or a high-tensile steel sheet having a tensile strength of 440 MPa or more without increasing a pad load considerably. In addition, the first press-forming apparatus 11 can provide the intermediate product having reduced cracking in the edges of the ridge flanges 7*a*, 7*b* and reduced wrinkling near the base of the ridge flanges 7*a*, 7*b*. Consequently, this leads to providing the structure member 1 of a superior rigidity and load transfer property as a final press formed product.

According to the embodiment, the ridge pad 15 is suspended from the die 14 via a coil spring, a gas cylinder, or the like. By moving the die 14 toward the punch 13, the ridge pad 15 first presses the forming material 16. The ridge pad 15 subsequently restrains the portions to be formed into the ridges 3*a*, 3*b* in the vicinity of the portion to be formed into the outward continuous flange 7 while leaving at least a part of the portion to be formed into the gutter bottom 2 unrestrained. The die 14 subsequently presses the forming material 16. Incidentally, the ridge pad 15 and the die 14 may be configured to be able to move independently toward the punch 13.

In the description above, the ridge pad 15 have had a configuration in which the restraining parts 15-1, 15-2 that are cut apart along the longitudinal direction are connected by the flange forming part 15-3. However, the structure of the ridge pad is not limited to this configuration. For example, the ridge pad may be a ridge pad 21, as illustrated in FIG. 11, which has two restraining parts 21-1, 21-2 by providing a recess 21-3. The recess 21-3 is disposed in the surface facing the punch 13, and corresponds to an unrestrained part of the portion to be formed into the gutter bottom 2. The ridge pad 21 illustrated in FIG. 11 may have a flange forming part (not shown) or may omit the flange forming part.

Incidentally, the ridge pads 15, 21 leave regions in which the die 14 does not press the forming material 16 against the punch 13. For example, the die 14 does not press a vertical wall and the flanges that are overlapped by the ridge pad 15, 21 in the pressing direction. When employing a die 14 that does not have a press surface corresponding to the portion to be formed into the gutter bottom 2, the gutter bottom 2 includes a region unpressed by the first press-forming apparatus 11. Such region is pressed in a second step. A press-forming apparatus to be used in the second step can be configured using a press-forming apparatus known in the art, and further description thereon is omitted.

(2-3. Manufacturing Method)

Now, a method for manufacturing a structural member for an automotive body according to the present embodiment will be explained specifically. The manufacturing method for a structural member for an automotive body according to the present embodiment is an example of the method for manufacturing the structural member 1 having the outward continuous flange 7 as illustrated in FIG. 1 by way of example.

(2-3-1. First Step)

FIG. 12 and FIG. 13 are schematic views illustrating a first step carried out by using the first press-forming apparatus 11. FIG. 12 is a sectional view schematically illustrating a state in which the ridge pad 15 restrains the forming material 16. FIG. 13 is a sectional view illustrating a state in which the die 14 presses the forming material 16. FIG. 12 and FIG. 13 illustrate a state in which the longitudinal end region of the forming material 16, in which an outward continuous flange 7 is formed, is pressed in the first step. In addition, the first press-forming apparatus 11 in which the ridge pad 15 is suspended from the die 14 is used in the manufacturing method described below.

In the first step, a developed blank having a shape in which the structural member 1 is developed flatly is provided as a forming material 16, and the forming material 16 is set on a punch 13. Subsequently, as illustrated by FIG. 12 and FIG. 6 (*a*), while the die 14 moves toward the punch 13, portions to be formed into ridges 3*a*, 3*b* in the vicinity of a portion to be formed into a outward continuous flange 7 in the forming material 16 are subsequently bent toward the pressing direction and restrained by the ridge pad 15. Meanwhile, a portion to be formed into a gutter bottom 2 remains unrestrained so that a relatively large pad load is exerted on the region pressed by the ridge pad 15. It should be noted that the whole portion or a part of the portion to be formed into the gutter bottom 2 in the vicinity of the portion to be formed into the outward continuous flange 7 may be restrained.

At this time, it is preferable that the ridge pad 15 presses a region of at least ⅓ of the perimeter length of the cross section of the portion to be formed into each ridge 3*a*, 3*b*. The ridge pad 15 presses the region so that restraining parts 15-1, 15-2 of the ridge pad 15 project the pressed steel sheet material outward, and form parts of the ridges 3*a*, 3*b* while the movement of the surrounding steel sheet material is reduced.

In addition, when the ridge pad 15 restrains the forming material 16 in the vicinity of the portion to be formed into the outward continuous flange 7, the end of the portion to be formed into the gutter bottom 2 remains unrestrained, which induces the deflection of the forming material 16 in the portion to be formed into the gutter bottom 2 as illustrated in FIG. 6 (*b*). This extends the lineal length of the ends of the portions to be formed into the ridges 3*a*, 3*b* and the gutter bottom 2 so that the edge-elongation percentage of each ridge flange 7*a*, 7*b* is reduced and shrinkage deformation near the base of each ridge flange 7*a*, 7*b* is also reduced. Consequently, cracking in the edge of each ridge flange 7*a*, 7*b* and wrinkling near the base thereof are reduced.

At this time, by making unrestrained the border between the portion to be formed into each ridge 3*a*, 3*b* and the portion to be formed into the gutter bottom 2 in the portions to be formed into the ridges 3*a*, 3*b*, it is possible to facilitate inducing the deflection of the gutter bottom 2. Accordingly, it is preferable that the extent that is not restrained in the end of the portion to be formed into each ridge 3*a*, 3*b* is at least ½ or more of the perimeter length of the cross section starting from the border between the portion to be formed into each ridge 3*a*, 3*b* and the portion to be formed into the gutter bottom 2.

In the shoulders 13*bb* of the punch 13 to be used, at least the longitudinal end of each shoulder 13*bb* that is proximate to the side wall 13*a* preferably has a curvature radius Rp of 2 mm or more. If the curvature radius Rp at the portion of the shoulder 13*bb* is less than 2 mm, it becomes difficult to disperse the strain generated in the end of the portion to be formed into each ridge 3*a*, 3*b* in the forming material 16 when the end is restrained by the pad 15. In contrast, if the curvature radius Rp at the portion of the shoulder 13*bb* exceeds 45 mm, the strain is relatively alleviated even though a known manufacturing method is employed to press the end of the portion to be formed into each ridge 3*a*, 3*b*. Consequently, a method for manufacturing a structural member for an automotive body according to the present embodiment is especially effective in manufacturing a structural member 1 having the ridges 3*a*, 3*b* of which the curvature radius Rp ranges from 2 mm to 45 mm.

The die 14 and punch 13 then carry out a first stage press forming with the die 14 further moving toward the punch 13 as illustrated in FIG. 13. In this way, the forming material 16 is pressed to form an intermediate product except, for example, the regions located under the ridge pads 13 in the pressing direction (16A in FIG. 13). Meanwhile, the ridge pads 15 restrain the portions to be formed into the ridges 3*a*, 3*b* in the vicinity of the portion to be formed into the outward continuous flange 7 while the portion to be formed into the gutter bottom 2 remains unrestrained.

Consequently, in the press forming using the die 14 and punch 15, the edge-elongation percentage of each ridge flange 7*a*, 7*b* and the shrinkage deformation near the base of each ridge flange 7*a*, 7*b* are also reduced. As a result, cracking in the edges and wrinkling near the base of the ridge flanges 7*a*, 7*b* of the obtained intermediate product are reduced.

The first stage press forming using the punch 13 and die 14 may be a bending step in which the die 14 presses and bends the forming material 16 against the punch 13. Alternatively, the first stage press forming may be deep drawing in which the die 14 and a blank holder move to the punch 13 to carry out press forming while the die 14 and the blank holder clamp the portions to be formed into the vertical walls in the forming material 16.

As described above, the forming material 16 is pressed, except, for example, the regions located under the ridge pads 15 (16A in FIG. 13) in the press direction in the first step, to form the intermediate product in the first step. Incidentally, although it is not shown in FIGS. 12 to 13, a part of the curved sections 5*a*, 5*b* and the flanges 6*a*, 6*b* of the structural member 1 illustrated by way of example in FIG. 1 may be pressed by the punch 13 and die 14 in the first step, or may be pressed in the subsequent second step.

(2-3-2. the Second Step)

After the first stage press forming is carried out in the first step, a second stage press forming is then carried out in the second step. The first step may not produce a product having a final shape because the ridge pad 15 does not press at least a part of the portion to be formed into a gutter bottom 2. In addition, the first step does not form a part of the portions to be formed into the vertical walls 4*a*, 4*b*, that is, the part being located under the ridge pad 15 and overlapped by the ridge pad 15 in the pressing direction, into final shapes as the structural member 1. In addition, the whole portions or a part of the portions to be formed into curved sections 5*a*, 5*b* and the flanges 6*a*, 6*a* of the structural member 1 may not be formed into final shapes in the first step.

Furthermore, a part of the ends of the portions to be formed into the ridges 3*a*, 3*b* may not be formed into final shapes in the first step either, depending on the region that the ridge pad 15 presses in the forming material 16. For example, when the ridge pad 15 presses a ½ perimeter region of the cross section of the portion to be formed into each ridge 3*a*, 3*b* in the first step, the remaining ½ perimeter region needs to be pressed later.

Accordingly, the punch and die in the second step using the second press-forming apparatus carry out the second stage press forming to press the intermediate product and form the structural member 1 having the final shape. The second step can be carried out by a known press forming method using a punch and die that have a press surface corresponding to a portion to be formed into the final shape.

Incidentally, the second step may be stamping press forming using a die and punch without using pads, or may be typical press forming using pads.

<3. Conclusion>

As described above, in accordance with the method for manufacturing a structural member for an automotive body, which includes a press-forming apparatus (first press-forming apparatus) 11 according to the present embodiment, and the first step using the first press-forming apparatus 11, there is obtained the structural member 1 having the outward continuous flange 7 formed from the gutter bottom 2 to each vertical wall 4*a* and 4*b* in the end in the predetermined direction. In the first step, the ridge pad 15 bends and restrains the ends of portions to be formed into the ridges 3*a*, 3*b* in the pressing direction. Meanwhile, regions except the end in the portion to be formed into the gutter bottom 2 are left unrestrained in the first step. Consequently, the deflection of the gutter bottom 2 is induced, and the perimeter of the cross section of the gutter bottom 2 and the ridges 3*a*, 3*b* becomes longer, which reduces cracking in the edge of the ridge flange 7.

In addition, the portion to be formed into the gutter bottom 2 is left unrestrained so that the load per unit area applied to the region restrained by the ridge pad 15 increases without increasing the pad load considerably. Accordingly, the ends of the portions to be formed into the ridges 3*a*, 3*b* are securely restrained by the ridge pad 15, and the portion of the steel sheet material that is pressed by the ridge pad 15 is made to project outward to form the ends of the ridges. This results in restraining the movement of the steel sheet material in the area surrounding the portions pressed by the ridge pad 15, and also suppressing an increase in the pad load, while obtaining the press formed product having reduced cracks in the edge of the outward continuous flange 7 and reduced wrinkles in the vicinity of the base of the outward continuous flange 7.

According to the present embodiment, as described above, the elongation and shrinkage deformation of the surrounding material, which cause cracking in the edge and wrinkling near the base of each ridge flange 7*a*, 7*b*, will be reduced even though a forming material 16 made of a steel sheet having a sheet thickness of 2.3 mm or more or a high-tensile steel sheet having a tensile strength of 440 MPa or more is used. Composing structural members for an automotive body from the press formed products that are formed in the above described way enables an improvement in the rigidity and in the load transfer property in the case where an impact load is applied.

A preferable embodiment has been described so far with reference to the accompanied drawings. The present invention, however, is not limited to the above described example. It will be evident that those skilled in the art to which the present invention pertains may conceive various alternatives and modifications while remaining within the scope of the technical idea as described in the claims. It should be understood that such alternatives and modifications apparently fall within the technical scope of the present invention.

EXAMPLE

Examples according to the present invention will now be described.

(1) Examples 1, 2 and Comparative Example 1

In Example 1, a structural member 1 was manufactured using a ridge pad 15 as illustrated in FIGS. 4 and 5 by the manufacturing method according to the present embodiment. In Example 1, the region of ½ of the perimeter length of the cross section of each ridge 3*a*, 3*b* remained unrestrained along each ridge 3*a*, 3*b* starting from the border between the each ridge 3*a*, 3*b* and a gutter bottom 2 in the ends of portions to be formed into ridges 3*a*, 3*b*.

In Example 2, a structural member 1 was manufactured using the ridge pad 15C illustrated in FIG. 10 by the manufacturing method according to the present embodiment. In Example 2, the ridge pad 15 restrained the region of the whole perimeter length of the cross section of each ridge 3*a*, 3*b* in the ends of portions to be formed into the ridges 3*a*, 3*b*. In addition to this, the end of the portion to be formed into a gutter bottom 2 was also restrained in Example 2.

In Comparative Example 1, as illustrated in FIGS. 7 (*a*) and (*b*), a structural member was manufactured while restraining the whole portion to be formed into the gutter bottom 2 in the forming material 16 and not restraining the ends of the portions to be formed into the ridges 3*a*, 3*b* under the same conditions as in Example 1 except using the pad 15'.

The forming material 16 was a 1.4 mm thick steel sheet having a tensile strength of 980 MPa class, which was measured by tensile testing in accordance with JIS Z 2241. In addition, the structural member to be manufactured had a substantially gutter-shaped cross section of 100 mm in height and 80 mm in gutter bottom width and an outward continuous flange 7 of 15 mm in flange width. Shoulders of a punch used had a curvature radius of 12 mm.

(1-1) Increase Rate of Sheet Thickness (Decrease Rate of Sheet Thickness)

Numerical analyses using the finite element method were performed on increase rates of sheet thickness (decrease rates of sheet thickness) in the vicinity of the ridge flanges 7*a*, 7*b* of the structural members to be manufactured in Example 1, 2 and Comparative Example 1. The analyses showed that a maximum decrease rate of sheet thickness in the edge of the ridge flange in the structural member according to Comparative Example 1 was about 29.8%, and a maximum increase rate of sheet thickness near the base of the ridge flange in the structural member according to Comparative Example 1 was about 17.0%.

In contrast, maximum decrease rates of sheet thickness in the edges of the ridge flanges 7*a*, 7*b* of the structural members 1 according to Examples 1, 2 were about 12.5% and about 13.4%, respectively. It was therefore shown that cracking in the edges of the ridge flanges 7*a*, 7*b* can be reduced more in the structural members 1 of Examples 1, 2 than in the structural member of Comparative Example 1. Maximum increase rates of sheet thickness near the base of the ridge flanges 7*a*, 7*b* of the structural members 1 according to Examples 1, 2 were about 14.1% and about 13.0%, respectively. It was therefore shown that wrinkling near the base of each ridge flange 7*a*, 7*b* can be reduced more in the structural members 1 of Examples 1, 2 than in the structural member of Comparative Example 1.

(1-2) A Pad Load

In manufacturing structural members according to Example 1 and Comparative Example 1, the pad load required for the pad pressing and restraining the forming material 16 against the punch 13 was then obtained. The results showed that the pad load of the ridge pad 15 of Example 1 was approximately 1.2 times larger than that of Comparative Example 1, and thus the ridge pad 15 of Example 1 did not require a considerable increase in the pad load.

(1-3) Extent of Restraining

Numerical analyses using the finite element method were then performed on the influence of a restraining extent in the portions to be formed into the ridges 3*a*, 3*b* on the increase rate of sheet thickness (decrease rate of sheet thickness) in the above-mentioned method of manufacturing the structural member 1 of Example 1. The angle θ of an unrestrained extent as illustrated in FIG. 6 (*a*) was changed within the range from 0° to 45°, where the angle θ=0° means that the whole end region of the portions to be formed into the ridges 3*a*, 3*b* is pressed. If the angle θ=45°, a ½ region of the perimeter of the cross section of each ridge 3*a*, 3*b* starting from the border between the portion to be formed into each ridge 3*a*, 3*b* and the portion to be formed into the gutter bottom 2 is left unrestrained.

The analyses showed that a maximum decrease rate of sheet thickness in the edges of the ridge flanges 7*a*, 7*b* when the angle θ=0° was about 13.1%. As the angle θ increased, in other words, as the restraining region decreased, the maximum decrease rate dropped, and when the angle θ=45°, a maximum decrease rate of sheet thickness in the edges of the ridge flanges 7*a*, 7*b* was 12.5%. When the angle θ is in the range from 0° to 45°, the maximum decrease rates of sheet thickness in the edges of the ridge flanges 7*a*, 7*b* are within an acceptable level.

(1-4) Curvature Radius of Shoulder of Punch

Numerical analyses using the finite element method were performed on the relationship between the decrease rate of sheet thickness in the edge of each ridge flange 7*a*, 7*b* to be formed and the curvature radius Rp of the shoulder 13*bb* of the punch 13 of the press-forming apparatus (the first press-forming apparatus) 11 used in the first step in the methods for manufacturing the structural members according to above-described Example 1 and Comparative Example 1. Structural members were manufactured using a forming material of a 2.3 mm thick steel sheet having a tensile strength of 590 MPa class, which was measured by tensile testing in accordance with ZIS Z 2241, under the same conditions except changing the curvature radius Rp of the shoulder 13*bb* of the punch 13. The curvature radius Rp of the shoulder 13*bb* of the punch 13 was changed within the range of 0 mm to 45 mm.

The analyses results are shown in FIG. 14. The horizontal axis represents the curvature radius Rp (mm) of the shoulder 13*bb* of the punch 13, and the vertical axis represents the maximum value (relative value) of the decrease rate of sheet thickness. FIG. 14 shows that the maximum value of the decrease rate of sheet thickness drops in the range of the curvature radius Rp of the shoulder 13*bb* being 45 mm or less when using the ridge pad 15 according to Example 1, as compared to the case of using the pad according to Comparative Example 1. In addition, in the case of using the ridge pad 15 according to Example 1, breakage in the edges of the ridge flanges 7*a*, 7*b* occurred when the curvature radius Rp of the shoulder 13*bb* was less than 2 mm, and a desired outward continuous flange 7 was unable to be obtained.

It was therefore shown that, when using the ridge pad 15 according to Example 1, the strain produced in the ends of the ridge flanges 7*a*, 7*b* and the ridges 3*a*, 3*b* can be reduced while maintaining the formability of the press formed product, as compared with the case of using the pad according to Comparative Example 1, if the curvature radius Rp of the shoulder 13*bb* of the punch 13 remains within the range from 2 mm to 45 mm.

(2) Examples 3, 4 and Comparative Example 2

In Examples 3, 4 and in Comparative Example 2, structural members were manufactured using a forming material 16 of a 3.2 mm thick steel sheet having a tensile strength of 270 MPa class, which was measured by tensile testing in accordance with ZIS Z 2241, under the same conditions as in Examples 1, 2 and Comparative Example 1.

(2-1) Increase Rate of Sheet Thickness (Decrease Rate of Sheet Thickness)

Numerical analyses using the finite element method were performed on increase rates of sheet thickness (decrease rates of sheet thickness) in the vicinity of the ridge flanges 7*a*, 7*b* of the structural members to be manufactured according to Example 3, 4 and Comparative Example 2. The analyses showed that a maximum decrease rate of sheet thickness in the edges of the ridge flanges in the structural member according to Comparative Example 2 was about 12.7%, and a maximum increase rate of sheet thickness near the bases of the ridge flanges in the structural member according to Comparative Example 2 was about 6.8%.

In contrast, maximum decrease rates of sheet thickness in the edges of the ridge flanges 7*a*, 7*b* of the structural members 1 according to Examples 3, 4 were about 7.5% and about 7.6%, respectively. It was therefore shown that cracking in the edges of the ridge flanges 7*a*, 7*b* can be reduced more in the structural members 1 of Examples 3, 4 than in the structural member of Comparative Example 2. Maximum increase rates of sheet thickness near the bases of the ridge flanges 7*a*, 7*b* of the structural members 1 according to Examples 3, 4 were about 5.2% and about 6.5%, respectively. It was therefore shown that wrinkling near the base of the ridge flanges 7*a*, 7*b* can be reduced more in the structural members 1 of Examples 3, 4 than in the structural member of Comparative Example 2.

(2-2) Pad Load

In manufacturing the structural members according to Example 3 and Comparative Example 2, the pad load required for the pad pressing and restraining the forming material 16 against the punch 13 was then obtained. The results showed that the pad load of the ridge pad 15 of Example 3 was approximately 1.3 times larger than that of the pad of Comparative Example 2, and thus the pad of Example 3 did not require a considerable increase in the pad load.

REFERENCE SIGNS LIST

1 structural member
2 gutter bottom
3*a*, 3*b* ridge
4*a*, 4*b* vertical wall
5*a*, 5*b* curved section
6*a*, 6*b* flange
7 outward continuous flange
7*a*, 7*b* ridge flange
11 press-forming apparatus (first press-forming apparatus)
13 punch
13*ba* upper surface
13*bb* shoulder
14 die
15, 15*a*, 15*b*, 15*c* pad (ridge pad)
15-1, 15-2 restraining part
16 forming material
20 jointed structure
21 pad (ridge pad)
21-1, 21-2 restraining part

The invention claimed is:

1. A press-forming apparatus used for manufacturing a structural member for an automotive body, the press-forming apparatus comprising:

a punch having a first end and a second end, an upper surface and a pair of shoulders extending in a longitudinal direction from the first end to the second end, the pair of shoulders being spaced from each other in a lateral direction;

a die spaced from the punch by a first distance in a pressing direction; and a pad facing the first end of the punch, the punch and the die carrying out press forming while the pad and the punch restraining a forming material made of a steel sheet, wherein the pad includes a plurality of restraining parts each of the plurality of restraining parts facing a respective shoulder of the punch, wherein the die and pad are spaced from each other in the longitudinal direction so as not to overlap when viewed in the pressing direction.

2. A press-forming apparatus used for manufacturing a structural member for an automotive body, the structural member extending in a predetermined direction, having a substantially gutter-shaped cross section intersecting the predetermined direction, and including a gutter bottom, a ridge continuing to the gutter bottom, a vertical wall continuing to the ridge, and an outward continuous flange being continuously formed along at least one end in the predetermined direction, the one end at least including a part of the ridge, a part of the gutter bottom, and a part of the vertical wall, the press-forming apparatus comprising:

a punch having a first end and a second end, and an upper surface and a pair of shoulders extending from the first end to the second end in a longitudinal direction, the pair of shoulders being spaced from each other in a lateral direction;

a die spaced from the punch by a first distance in a pressing direction; and a pad facing the first end of the punch, the punch and the die carrying out press forming while the pad and the punch restraining a forming material made of a steel sheet, wherein the pad includes a plurality of restraining parts each of the plurality of restraining parts facing a respective shoulder of the punch, wherein the die and pad are spaced from each other in the longitudinal direction so as not to overlap when viewed in the pressing direction.

3. The press-forming apparatus according to claim 2, wherein the pad leaves at least a part of the end of the portion to be formed into the gutter bottom unrestrained.

4. The press-forming apparatus according to claim 2, wherein the pad leaves unrestrained the whole portion to be formed into the gutter bottom and at least a part of the portion corresponding to the flange to be formed in the end of the gutter bottom, the part continuing to the portion to be formed into the gutter bottom.

5. The press-forming apparatus according to claim 2, wherein the pad leaves unrestrained a portion of at least ½ length of a perimeter of a cross section in the end of the portion to be formed into the ridge, the ½ length starting from a border between the portion to be formed into the ridge and the portion to be formed into the gutter bottom.

6. The press-forming apparatus according to claim 2, wherein each shoulder has a surface for forming the ridge, and at least a portion of each shoulder corresponding to the end in the predetermined direction has a curvature radius ranging from 2 mm to 45 mm.

7. The press-forming apparatus according to claim 2, wherein the retraining parts partially extend over the upper surface of the punch, wherein each restraining part has a distal edge, and wherein distal edges of the retraining parts extend in the longitudinal direction and are spaced from each other in the lateral direction to form a space therebetween.

8. The press-forming apparatus according to claim 2, wherein the die covers the pair of shoulders of the punch.

9. The press-forming apparatus according to claim 7, wherein the punch includes a side wall extending upward from the first end of the punch, and wherein the pad includes a flange overlying the side wall.

10. The press-forming apparatus according to claim 2, wherein the pad is spaced from the die a second distance in the pressing direction, the second distance being less than the first distance.

11. A method for manufacturing a structural member for an automotive body by using the press-forming apparatus according to claim 2, the structural member being formed by pressing the forming material made of the steel sheet, the structural member extending in the predetermined direction, having the substantially gutter-shaped cross section intersecting the predetermined direction, and including the gutter bottom, the ridge continuing to the gutter bottom, the vertical wall continuing to the ridge, and the outward continuous flange being continuously formed along the at least one end in the predetermined direction, the one end at least including the part of the ridge, the part of the gutter bottom, and the part of the vertical wall, the method comprising:

a first step in which the pad presses the forming material against the punch to raise a portion corresponding to a flange to be formed in ends of at least the gutter bottom and the ridge in a direction opposite to the pressing direction, and the punch and the die carry out press forming to form an intermediate product, while the pad bends an end of a portion to be formed into the ridge in the pressing direction and restrains at least a part of the end, and a region other than an end in a portion to be formed into the gutter bottom remains unrestrained; and a second step in which the intermediate product is further pressed to form the structural member for the automotive body.

12. The method for manufacturing a structural member for an automotive body according to claim 11, wherein at least a part of the end of the portion to be formed into the gutter bottom is unrestrained in the first step.

13. The method for manufacturing a structural member for an automotive body according to claim 11, wherein the whole portion to be formed into the gutter bottom and at least a part of the portion corresponding to the flange to be formed in the end of the gutter bottom, the part continuing to the portion to be formed into the gutter bottom, remain unrestrained in the first step.

14. The method for manufacturing a structural member for an automotive body according to claim 11, wherein a portion of at least ½ length of a perimeter of a cross section in the end of the portion to be formed into the ridge, the ½ length starting from a border between the portion to be formed into the ridge and the portion to be formed into the gutter bottom, remains unrestrained in the first step.

15. The method for manufacturing a structural member for an automotive body according to claim 11, wherein, the punch used in the first step has a shoulder having a surface for forming the ridge, and at least a portion of the shoulder corresponding to the end in the predetermined direction has a curvature radius ranging from 2 mm to 45 mm.

16. The method for manufacturing a structural member for an automotive body according to claim 11, wherein the steel sheet is a steel sheet of 2.3 mm or more in thickness or a high-tensile steel sheet of 440 MPa or more in tensile strength.

* * * * *